US008122609B2

(12) United States Patent
Farr et al.

(10) Patent No.: US 8,122,609 B2
(45) Date of Patent: Feb. 28, 2012

(54) STEP AND RAFTER TOOL

(76) Inventors: Harvey H. Farr, Paoli, IN (US); William H. Farr, Austin, IN (US)

( * ) Notice: Subject to any disclaimer, the term of this patent is extended or adjusted under 35 U.S.C. 154(b) by 0 days.

(21) Appl. No.: 12/807,810

(22) Filed: Sep. 14, 2010

(65) Prior Publication Data

US 2011/0107610 A1 May 12, 2011

(51) Int. Cl.
*B43L 7/12* (2006.01)

(52) U.S. Cl. ..... 33/421; 33/417; 33/420

(58) Field of Classification Search ..... 33/418–423, 33/425, 427, 465
See application file for complete search history.

(56) References Cited

U.S. PATENT DOCUMENTS

| | | | | | |
|---|---|---|---|---|---|
| 243,592 | A | | 6/1881 | Marvick | |
| 327,283 | A | | 9/1885 | Levy | |
| 614,259 | A | * | 11/1898 | Bouldry | 33/419 |
| 666,346 | A | * | 1/1901 | Goelzer | 33/420 |
| 935,067 | A | * | 9/1909 | Taylor | 33/42 |
| 1,006,815 | A | | 10/1911 | Wiegman | |
| 1,050,969 | A | | 1/1913 | McLeod | |
| 1,056,917 | A | | 3/1913 | Len | |
| 1,074,969 | A | * | 10/1913 | Moore | 33/423 |
| 1,187,272 | A | | 6/1916 | Demmrich | |
| 1,189,983 | A | | 7/1916 | McLeod | |
| 1,237,790 | A | | 8/1917 | Kidder | |
| 1,249,496 | A | * | 12/1917 | Reveal | 33/419 |
| 1,301,166 | A | * | 4/1919 | Potter | 33/420 |
| 1,770,304 | A | | 7/1930 | Ferris | |
| 1,916,638 | A | * | 7/1933 | Rizianu | 33/418 |
| 2,048,846 | A | * | 7/1936 | Davis | 33/465 |
| 2,582,892 | A | * | 1/1952 | Tarperi | 33/419 |
| 3,015,163 | A | * | 1/1962 | Cummings | 33/421 |
| 3,112,568 | A | | 12/1963 | Baker | |
| 3,153,859 | A | * | 10/1964 | Jones | 33/419 |
| 4,955,141 | A | * | 9/1990 | Welch | 33/418 |
| 5,384,967 | A | * | 1/1995 | Helmuth | 33/456 |
| 5,388,340 | A | | 2/1995 | Marty | |
| D444,718 | S | * | 7/2001 | Ross et al. | D10/65 |
| 7,073,240 | B2 | * | 7/2006 | Eberly | 33/474 |
| 7,854,070 | B1 | * | 12/2010 | Vajentic | 33/417 |

* cited by examiner

*Primary Examiner* — Yaritza Guadalupe-McCall
(74) *Attorney, Agent, or Firm* — Carrithers Law Office PLLC

(57) ABSTRACT

A tool for use when laying out lines on stair stringers or roof rafters along which cuts are to be made. The step and rafter tool includes a framing square, an angle bracket and two carriage bolts with washers and wingnuts. Each leg of the framing square has a longitudinal slot which is about 90% of the length of the leg. The angle bracket has two central longitudinal slots in the first flange, each of which is about 40% of the length of the angle bracket. The angle bracket is positioned against the framing square so that two carriage bolts are place within holes formed by the overlapping slots of the bracket and square with washers and wingnuts assembled therein. With the wingnuts loose, the angle bracket can be positioned wherever is desired with respect to the framing square and then the wingnuts are tightened. The second flange of the angle bracket now provides a shoe which can slide on the narrow side of a board to be marked and cut for use as a stair stringer or a roof rafter, and thereby stabilize the framing square in place to act as a marking guide. Various indicia, guide marks and data tables are engraved into the legs of the framing square to aid in set up and marking. The edges of the slots in the framing square also provide useful marking guides which are a known distance from other outer or inner edges of the framing square legs.

13 Claims, 4 Drawing Sheets

| Hip Jacks | Pitch | 4 | 5 | 6 | 8 | 10 | 12 |
|---|---|---|---|---|---|---|---|
| per foot of run | 16"o.c. | 16 7/8 | 17 5/16 | 17 7/8 | 19 1/4 | 20 15/16 | 22 5/8 |
| | 24"o.c. | 25 5/16 | 26 | 26 13/16 | 28 7/8 | 31 1/4 | 33 15/16 |

| Hip and Valley Pitch | 4 | 5 | 6 | 8 | 10 | 12 |
|---|---|---|---|---|---|---|
| Per foot of run | 17.44 | 17.69 | 18 | 18.76 | 19.70 | 20.78 |

STEP AND RAFTER TOOL

TECHNICAL FIELD

The present invention relates to framing squares used in marking cut lines for stair stringers, roof rafters and the like.

DESCRIPTION OF THE RELATED ART

Framing squares are well known in the art of carpentry. Brackets have been added to framing squares to act as guides or reference edges.

U.S. Pat. No. 327,283 by Levy for "ADJUSTABLE PITCH BOARD FOR SQUARES" which issued on Sep. 29, 1885 teaches tow sliding rulers, one held on each side of a framing square by bolts in slots contained within the scales and the framing square.

U.S. Pat. No. 1,189,983 by McLeod for "FRAMING TOOL" which issued on Jul. 4, 1916 teaches a pair of rulers containing long slots wherein are contained bolt and nut units. The rulers have a framing square captured thereinbetween. The rulers can be positioned on the framing square and tightened. The rulers and framing squares have indicia and marks engraved therein.

U.S. Pat. No. 5,388,340 by Marty for STAIR LAYOUT SQUARE WITH ADJUSTABLE RAKE BAR" which issued on Feb. 14, 1995 teaches a plate forked on both end wherein the legs of a framing square can slide. Slots in the square and in the edge of the forks have a bolt and nut unit therein which can be tightened when the user has the plate properly positioned. Indicia are engraved into the surface of the framing square.

BACKGROUND OF THE INVENTION

Levy teaches an adjustable framing tool with indicia but contains no reference tables for set up. Further, Levy doesn't provide a side bracket with a generous surface area, but instead has narrow ruler edges which can easily slide off the edge of the board.

McLeod also teaches an adjustable framing tool with indicia plus reference tables. However, the framing square is not slotted to receive the bolts and would therefore easily loose it's setting. Further, the adjustable sliding scale is thin and will slide off the edge of the board during use.

Marty teaches an adjustable framing tool which provides a generous surface to contact both the front face and the narrow side of the board and provides marks and indicia to help set up the tool for stringer marking. However, Marty lacks any marks, indicia or reference tables to set the tool for rafter line marking.

A step and rafter tool is presented herein for marking cut lines on a board to be used as a step stringer or roof rafter. This too provides all the elements of the related art mentioned above and more. The tool comprises a framing square with long slots running down the center of each leg, an angle bracket with long slots running down the center of one flange, and two clamping units which can clamp the angle bracket against the framing square to hold them in a fixed face to face position relative to one another so that the user can use the tool to make cut lines at repeatable angles on a board. The angle bracket provides a broad surface for sliding the toll against the narrow edge of a board.

On one face of the framing square are a reference table and marks which are laid off in inches and fractions of a inches and labeled with numbers indication inches. The reference table gives inches of 'rise' for a step when the floor-to-floor height in inches is known. If the user knows the tread depth, toe board thickness, and overhang, then the 'run' can be easily determined. The user now sets the angle bracket to correspond to the 'rise' and 'run' and tightens the clamps. The tool is now ready to mark all the step cut lines.

On the opposite face of the framing square are pitch guidelines and a handy reference table to help a user figure rafter lengths given rafter type and the roof pitch, and 'run' lengths. If the desired roof pitch is known, the user simply sets the lower edge of the angle bracket to correspond to the guidelines marked on the legs of the framing square and tightens the clamps. The tool is now ready to use to mark all rafter cuts including the end cuts and the notch call the 'bird's mouth' which provides a seat wear the rafter is connected to the outer wall of the building.

In order to figure the length of a rafter, the user needs the rafter type, the roof pitch, and 'run' length (or horizontal distance covered by the rafter). Given these three pieces of data, the user finds in the reference table a 'multiplier' corresponding to the rafter type and roof pitch. The desired rafter length (in inches) is simply the product of the 'run' length (in inches) and the 'multiplier'.

SUMMARY OF THE INVENTION

A step and rafter tool to be used as a guide for marking cut lines on boards to be used as stair stringers or roof rafters comprising: a framing square, an angle bracket with two flanges, and means for removably clamping one flange of the angle bracket to a face of the framing square. The framing square includes two faces and two legs. The first face contains a first set of marks and indicia, and a first reference table useful in setting up the tool for stair stringer marking. The second face contains a second set of marks and indicia, and a second reference table useful in setting up the tool for roof rafter marking. The two legs contain longitudinal slots which are approximately 90% of the length of the legs. The first flange of the angle bracket contains two central longitudinal slots each being approximately 40% of the length of the first flange wherein the first flange is held in a face-to-face relationship to a face of the framing square and the two slots in the first flange overlap the slot in the framing square forming two apertures wherein the clamping means are inserted therethrough and tightened. The second flange of the angle bracket provides a surface which may come to bear and slide along a narrow side of a board to be marked.

It is an object of the present invention is to provide a step and rafter tool comprising cooperative members which can be quickly and easily set to a predetermined position relative to one another, that position being clearly indicated by lines and indicia engraved within the members.

Another object of the present invention is to provide a step and rafter tool which can be set once for a given pitch for a particular stringer or roof rafter and then be used to mark all those steps or rafters without the need of subsequent changes in the tool setting.

Another object of the present invention is to provide a step and rafter tool which contains reference tables which give the exact settings for the tool for various roof pitches and stair stringer pitches without the need of any calculations.

Another object of the present invention is to provide a step and rafter tool which contains an easy to use reference tables which make calculation of rafter lengths for various situations such as hip, hip jack or common roof rafters easy.

Another object of the present invention is to provide a step and rafter tool which has two generous surfaces to slide on both the front face and the narrow side of the board at the same time to make movement and use of the tool quick and easy.

Another object of the present invention is to provide a step and rafter tool which contains a scale marked off in inches near the outer edge of one face of both legs of the framing square for use in stair stringer marking.

Another object of the present invention is to provide a step and rafter tool wherein slots contained in the tool provide one edge which is ¾ inch from the outer edge of the leg of the framing square and another edge which is ⅜ inch from the outer edge of the leg of the framing square for handy reference and marking. Further, each of the two legs should be 1½ inches wide, providing another handy reference guideline.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided a device step and rafter tool which can be used as a guide to mark cutting lines onto boards intended to be used as stair stringers or as roof rafters.

When marking a set of stair stringers, the step and rafter tool can be easily adjusted to the correct setting for a particular stair stringer. At that point, the tool can be used to mark all of the step cuts in the stringer without further changes in the setting. The tool ensures that all the steps will be marked the same. The angle bracket maintains the proper angle and the flange extending out from the tool acts as a shoe which is held against and can slide on the narrow side of a board as the user positions the tool to mark the board.

Likewise, when marking a set of rafters, the tool can be easily adjusted to the correct setting for a particular rafter. At that point, the tool can be used to mark all of the rafters for that part of the roof with that particular pitch without further changes in the setting. The user marks both ends of the rafters and the notch called the birds mouth using the tool. The tool ensures that all the rafters will be marked the same.

Figure 1:
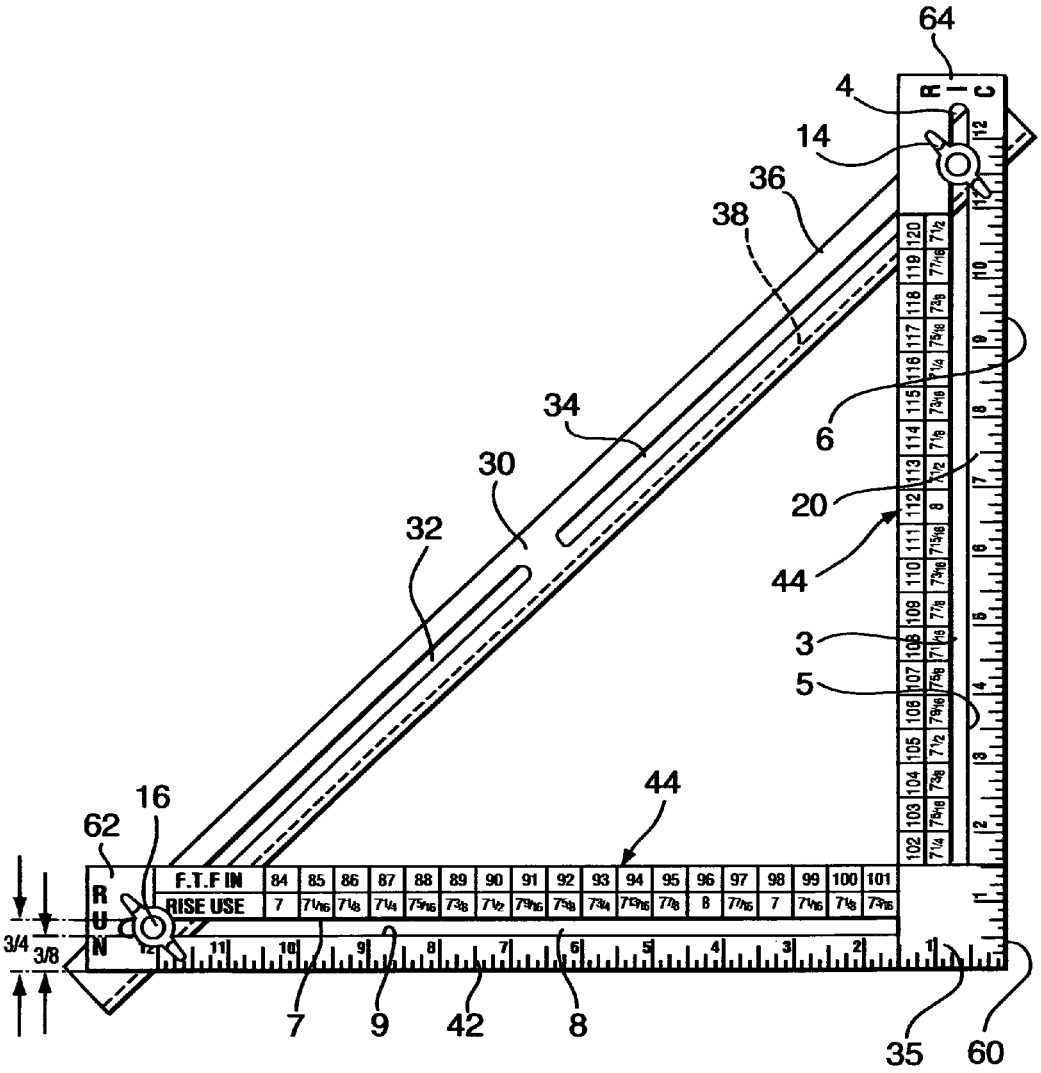
FIG. 1 is a view of the step and rafter tool showing the side used as a guide to mark steps.
Figure 1A:
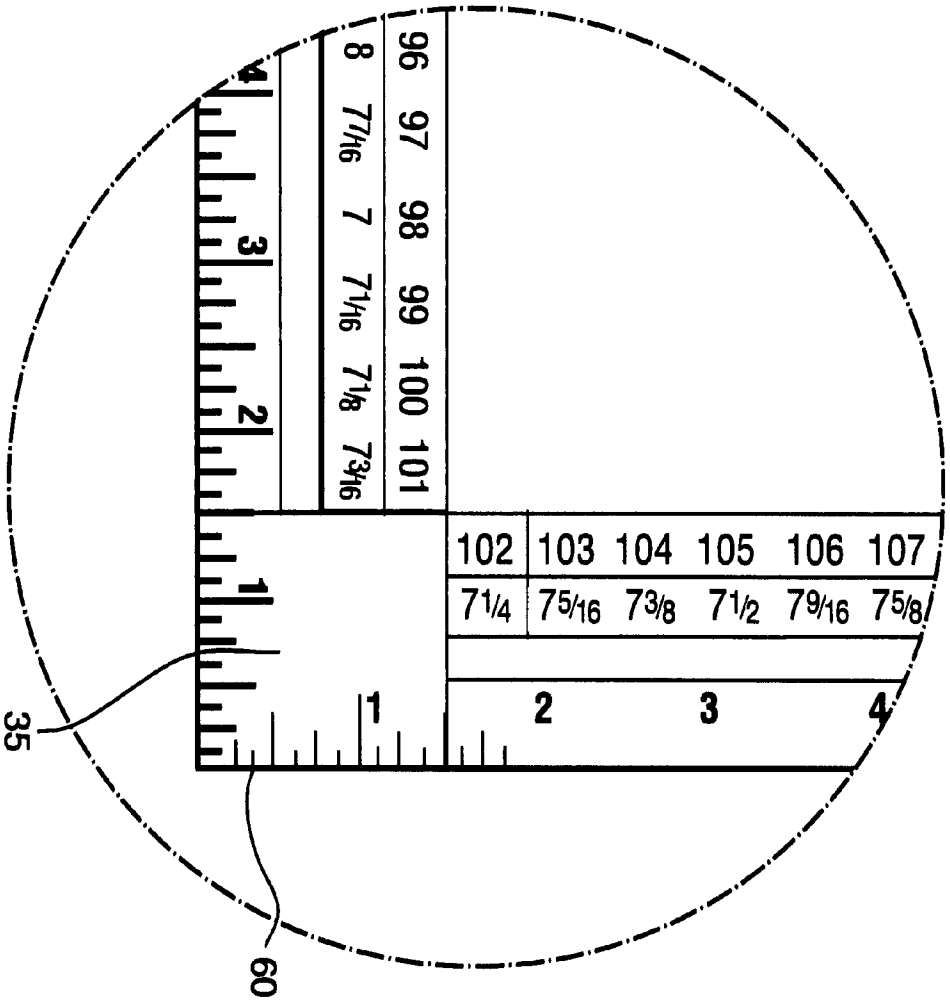
FIG. 1A shows an enlarged view of a portion of FIG. 1.

FIG. 1 shows the step and rafter tool 10, comprising a framing square 60, an angle bracket 30, and two bolt, washer and nut units 14 and 16. Angle bracket 30 shaped like a standard 'angle iron' includes two flanges, a first flange 36 containing central longitudinal slots 32 and 34 which is held in face-to-face relation to a face of framing square 60 by bolt and wingnut units 14 and 16. The second flange 38 will (during use) come into face-to-face relationship with a narrow side 72 of a board 70 to be marked. Framing square 60 has two faces. Face 35 is used for setting up the tool for marking stair stringers and contains a reference table, marks and indicia for marking stringers. Face 50 is used when marking roof rafters and contains useful reference tables, marks and indicia for marking rafters.

Referring to FIG. 1, framing square 60 comprises legs 62 and 64 which contain slots 8 and 4 respectively. Face 35 is to be used for setting up the tool for marking stair stringers and contains indicia, marks and reference table 44. Reference table 44 gives the riser height in inches for a given floor to floor distance in inches. Marks and indicia 20 and 42 near the outer edge of legs 64 and 62 comprise a scale marked off in inches. The depth of a standard step is 11¼ inches, but the user can use whatever depth is desired. With this information, the user simply sets the lower end of the angle bracket to correspond to the desired tread depth (e.g. 11¼ inches) and the upper end of the angle bracket to whatever riser height was determined from the reference table and then tightens the wingnuts. The tool is now set and ready to use.

Figure 2:
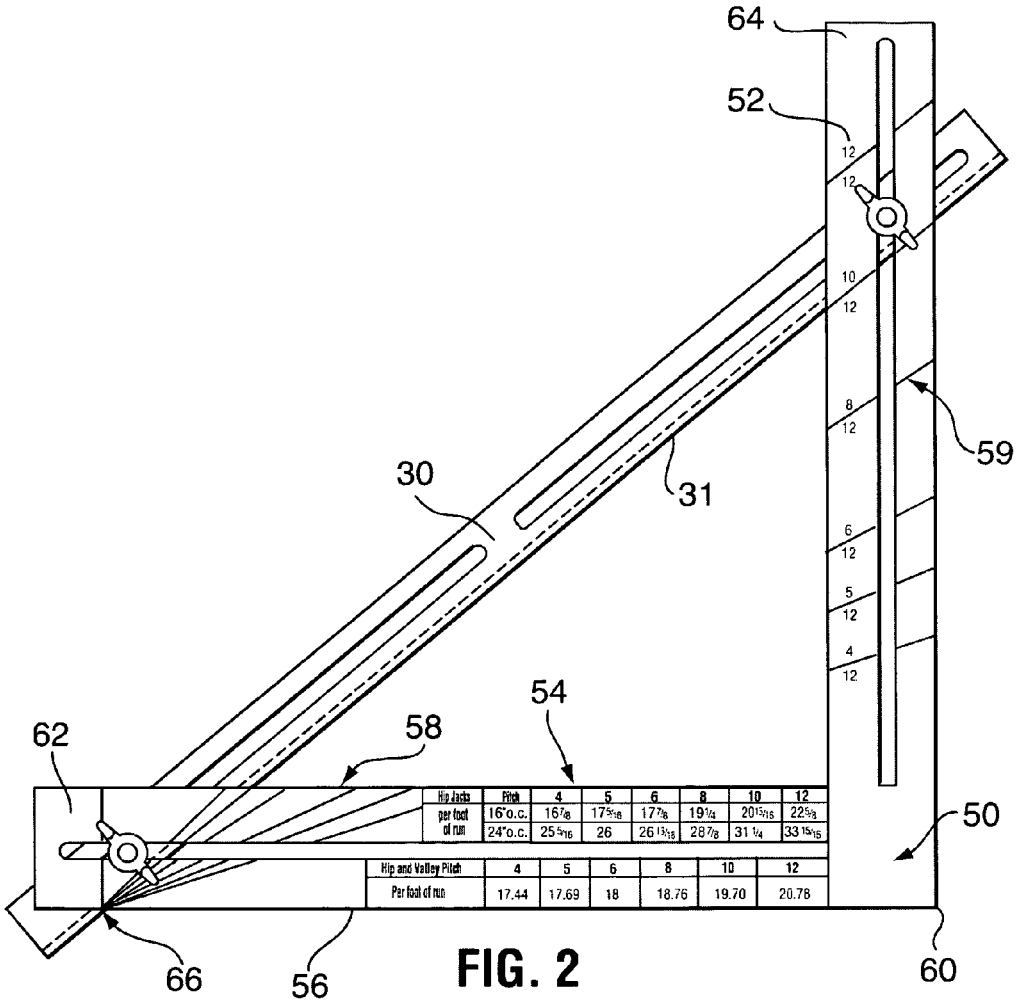
FIG. 2 is a view of the step and rafter tool showing the side to be used as a guide to mark rafters.
Figure 3:
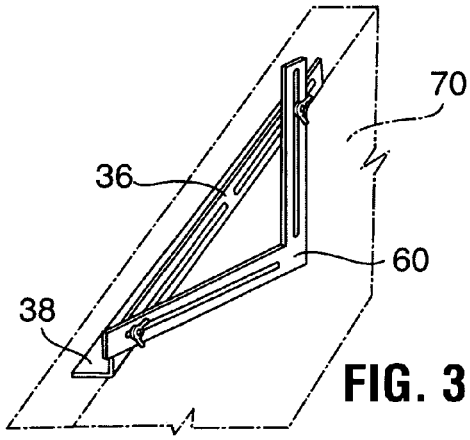
FIG. 3 is a perspective view of the step and rafter tool showing the tool in place on a board to be marked.
Figure 4:
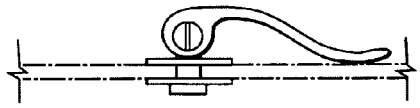
FIG. 4 is a side view of an over center clamping means.
Figure 2A:
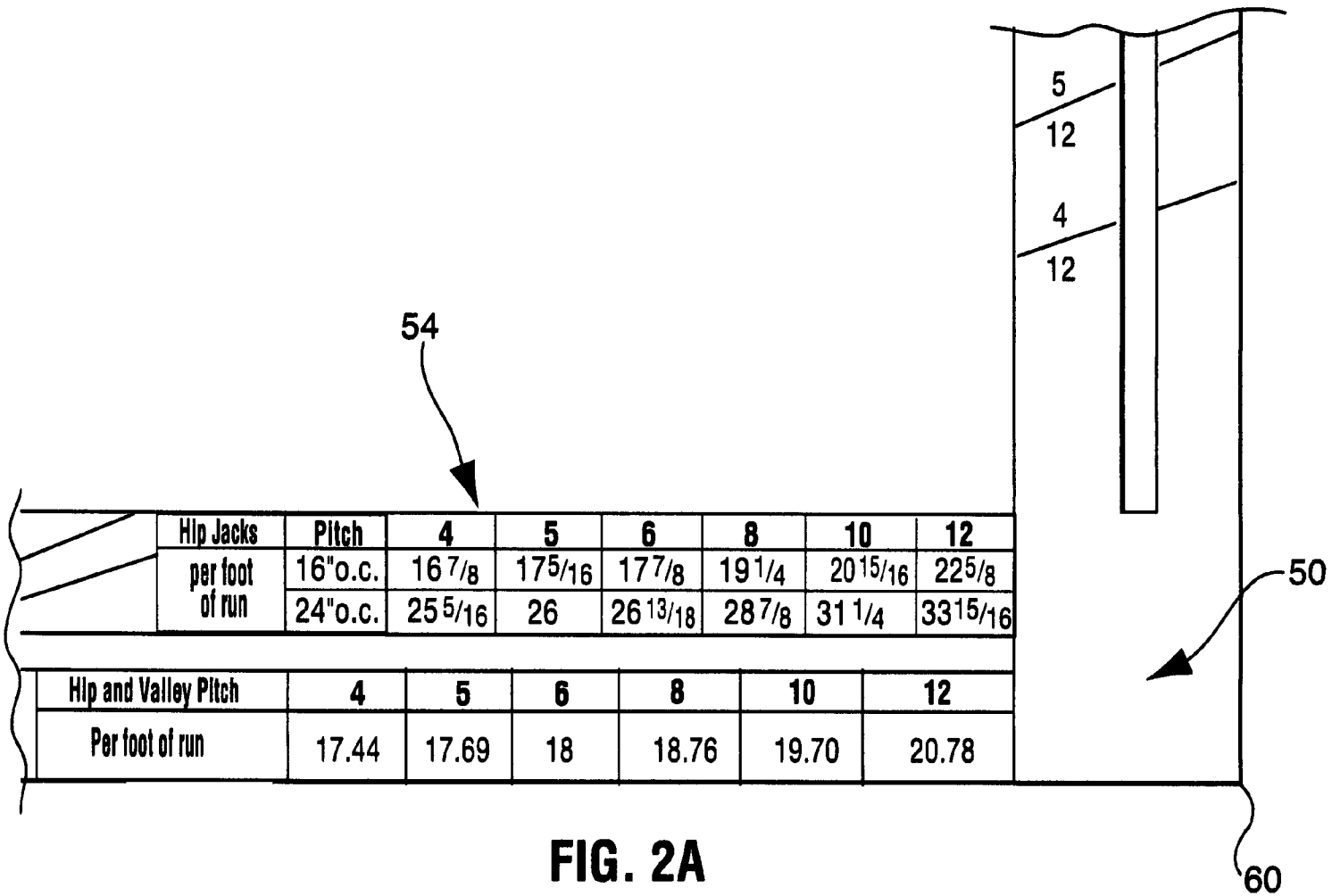
FIG. 2A shows an enlarged view of a portion of FIG. 2.

Face 50 on framing square 60 is to be used for tool set up when marking roof rafters. Referring to FIG. 2, face 50 contains marks 59 on leg 64 corresponding to and including indicia for 4-12, 5-12, 6-12, 8-12, 10-12 and 12-12 pitches which are standard roof pitches. Marks 58 on leg 62 are corresponding pitch marks with each ending at a common pivot point 66 of the lower edge of leg 62. A user simply adjusts the angle bracket 30 so that it's lower edge 31 aligns with both the pivot point 66 and the mark 59 which corresponds to the desired roof pitch. At this point, the user can tighten the wingnuts and the tool is now ready to use for marking rafter cut lines.

Reference tables 54 and 56 are not used for tool set up, but are provided to help in calculating rafter lengths for common, hip, and hip jack rafters. For a given rafter type and a given pitch, the table gives a number that can be multiplied by the 'run' in inches (the horizontal distance covered by that rafter including the overhang). The resulting number is the length to which the rafter should be cut.

Each of legs 62 and 64 is 1½ inches wide. Slots 8 and 4 are located such that edges 7 and 3 are exactly in the center and ¾ inch from either edge of legs 62 and 64. Edges 9 and 5 are ⅜ inch from the outer edges of legs 62 and 64. Each of the four edges in legs 62 and 64 are useful points of reference.

Means of clamping flange 36 to square 60 other than bolt and wingnut units 14 and 16 may be used. For example, over center toggle fastener 80 provides quicker and easier clamping. Another example is a bolt and nut unit comprising a carriage bolt and a knurled nut rather than a wingnut.

As an example of the use of the tool to mark stringer cuts, assume a user needs to mark a step stringer for a staircase which bridges a height of 84 inches. The riser height in inches for an 'FTF' (or floor-to-floor) of 84 given from the reference table is 7 inches. The treads will be 11½ inches in depth. The toe board is ¾ inches thick. This gives a total depth of 11½+¾=12¼ inches. A one inch overhang is desired. Therefore, the cut for the step needs to be 12¼−1=11¼ inches deep and 7 inches high. The user now loosens the wing nuts or locking retainers 14 and 16 that hold the angle bracket 30 to the square and slides the angle bracket 30 so that its lower edge 31 corresponds to 11¼ inches on leg 62 and labeled 'RUN' and to 7 inches on leg 64 labeled 'RISE' and then re-tighten locking retainers 14 and 16.

NOTE: THIS SETTING IS THE ONLY SETTING REQUIRED FOR ALL CUTS NEEDED FOR THESE STAIRS!!! Now the user simply positions the tool on the board and makes the marks for all the step cuts.

On the other hand, to mark rafter cuts, the user loosens the wing nuts or locking retainers 14 and 16 that hold the angle bracket 30 to the square and slides the angle bracket 30 so that its lower edge corresponds to the guidelines provided on face 50 corresponding to the desired roof pitch. For example, to mark rafters for an 8-12 pitch, set the lower edge 31 of angle bracket 30 to the marks corresponding to the two marks for an 8/12 pitch labeled on leg 62 and 64 and then re-tighten locking retainers 14 and 16. AGAIN: THIS SETTING IS THE ONLY SETTING REQUIRED FOR ALL CUTS NEEDED FOR THESE RAFTERS!!! Now the user simply positions the tool on the board and makes the marks for all the rafter cuts including the notch called the 'bird's mouth' which provides a seat where the rafter is connected to the outside wall.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A step and rafter tool to be used as a guide for marking cut lines on boards to be used as stair stringers or roof rafters comprising:

a framing square, said framing square comprising two faces and two legs, the first face containing a first set of marks and indicia, and a first reference table useful in setting up said tool for stair stringer marking, the second face containing a second set of marks and indicia, and a second reference table useful in setting up said tool for roof rafter marking, said two legs having formed therein longitudinal slots which are approximately 90% of the length of said legs;

said two legs of said framing square are one and one half inches wide and wherein said longitudinal slots provide a first edge which is ¾ inch from an outer edge of said leg of said framing square and a second edge which is ⅜ inch from said outer edge of said leg of said framing square for handy marking guides;

an angle bracket comprising two flanges including a first flange and a second flange;

means for removably clamping a first flange of said angle bracket to a face of said framing square; and said first flange of said angle bracket having formed therein two central longitudinal slots each of which is approximately 40% of the length of said first flange wherein said first flange is held in a face-to-face relationship to a face of said framing square and said two central longitudinal slots in said first flange overlap said longitudinal slots in said framing square forming two apertures wherein said clamping means are inserted therethrough and tightened, said second flange of said angle bracket providing a broad tool-supporting surface which may come to bear and slide along a narrow side of a board to be marked.

2. The step and rafter tool defined in claim 1 wherein said first set of marks and indicia include a scale marked off in inches near the outer edges of each of said legs and numbering starting at the corner of said square to provide guide lines for positioning said angle bracket relative to said framing square.

3. The step and rafter tool defined in claim 1 wherein said first reference table lists the riser height in inches for a given floor to floor distance in inches.

4. The step and rafter tool defined in claim 1 wherein said second set of marks and indicia includes marks on said square providing guide lines for positioning said angle bracket relative to said square, said marks arranged according to common roof pitches and labeled accordingly.

5. The step and rafter tool defined in claim 1 wherein said second reference table lists a factor for given common roof pitches which may be multiplied by the rafter 'run' length to calculate a rafter length for common, hip or hip jack rafters.

6. The step and rafter tool defined in claim 1 wherein said clamping means is selected from a list consisting of over center toggle clamping device, carriage bolt-flat washer-wingnut unit, or carriage bolt-flat washer-knurled nut unit.

7. The step and rafter tool defined in claim 1 wherein said first set of marks and indicia include a scale marked off in inches near the outer edges of each of said legs and numbering starting at the corner of said square to provide guide lines for positioning said angle bracket relative to said framing square.

8. The step and rafter tool defined in claim 2 wherein said first first set of marks and indicia list the riser height in inches for a given floor to floor distance in inches.

9. The step and rafter toot defined in claim 1 wherein said second set of marks and indicia include marks on said square providing guide lines for positioning said angle bracket relative to said square, said marks arranged according to common roof pitches and labeled accordingly.

10. The step and rafter tool defined in claim 1 wherein said second reference table lists a factor for given common roof pitches which may be multiplied by the rafter 'run' length to calculate a rafter length for common, hip or hip jack rafters.

11. The step and rafter tool defined in claim 1 wherein said clamping means is selected from a list consisting of over center toggle clamping device, carriage bolt-flat washer-wingnut unit, or carriage bolt-flat washer-knurled nut unit.

12. A step and rafter tool to be used as a guide for marking cut lines on boards to be used as stair stringers or roof rafters comprising:

a framing square, said framing square comprising two faces and two legs, the first face containing a first set of marks and indicia useful in setting up said tool for stair stringer marking, the second face containing a second set of marks and indicia useful in setting up said tool for roof rafter marking, each one of said two legs of said framing square including at least one longitudinal slot of a selected length extending there along;

an angle bracket comprising two flanges including a first flange and a second flange;

means for removably clamping a first flange of said angle bracket to a face of said framing square; and said first flange of said angle bracket having formed therein at least one central longitudinal slot wherein said first flange is held in a face-to-face relationship to a face of said framing square and said at least one central longitudinal slot in said first flange overlaps said at least one longitudinal slot in said framing square forming two apertures wherein said clamping means are inserted therethrough and tightened, said second flange of said angle bracket providing a broad tool-supporting surface which may come to bear and slide along a narrow side of a board to be marked; and said two legs of said framing square are one and one half inches wide and wherein said longitudinal slots provide a first edge which is ¾ inch from an outer edge of said leg of said framing square and a second edge which is ⅜ inch from said outer edge of said leg of said framing square for handy marking guides.

13. The step and rafter tool of claim 12, wherein said first flange of said angle bracket further including at least two central longitudinal slots.

* * * * *